United States Patent [19]

Ishimoto et al.

[11] 4,218,129

[45] Aug. 19, 1980

[54] ELECTROPHOTOGRAPHIC APPARATUS

[75] Inventors: Osamu Ishimoto; Masaji Nishikawa; Masaru Yamazaki, all of Hachioji, Japan

[73] Assignee: Olympus Optical Co., Ltd., Tokyo, Japan

[21] Appl. No.: 903,029

[22] Filed: May 4, 1978

[30] Foreign Application Priority Data

May 6, 1977 [JP] Japan ..... 52-51281

[51] Int. Cl.[2] ..... G03G 15/00

[52] U.S. Cl. ..... 355/14 SH; 355/3 SH

[58] Field of Search ..... 355/14 R, 3 R, 3 SC, 355/3 SH, 14 SH

[56] References Cited

U.S. PATENT DOCUMENTS

| | | | |
|---|---|---|---|
| 3,623,806 | 11/1971 | Short | 355/64 X |
| 3,752,573 | 8/1973 | Miller | 355/14 X |
| 3,830,590 | 8/1974 | Harris et al. | 355/14 |
| 3,886,329 | 5/1975 | Kamiyama | 355/14 X |
| 4,000,943 | 1/1977 | Bar-On | 355/8 |
| 4,046,466 | 9/1977 | Ando et al. | 96/1 R X |

FOREIGN PATENT DOCUMENTS

| | | | |
|---|---|---|---|
| 2728337 | 12/1977 | Fed. Rep. of Germany | 355/3 SC |

*Primary Examiner*—R. L. Moses

*Attorney, Agent, or Firm*—Haseltine, Lake & Waters

[57] ABSTRACT

An electrophotographic apparatus particularly suitable for printing a plurality of duplicated copies from each of a plurality of sheet-like documents comprising a sheet-like document feeding device for feeding the sheet-like document at a constant velocity, an optical system including an illumination lamp and a projecting lens for exposing and scanning the document during the traveling of the document, a photosensitive drum for forming a latent image corresponding to the document image and retaining the latent image for a relatively long time period, a device for developing the latent image with toner particles, a device for transferring the toner image onto a record paper and a device for fixing the toner image on the paper. After the latent image has been once formed on the photosensitive drum the given number of duplicated copies are formed by repeatedly effecting the development, transfer and fixing operations. The document can be set in the document feeding device while the duplicating operation for forming a plurality of copies for the previous document is carried out.

5 Claims, 2 Drawing Figures

ELECTROPHOTOGRAPHIC APPARATUS

BACKGROUND OF THE INVENTION

The present invention relates to an electrophotography, and more particularly an electrophotographic apparatus for forming a plurality of duplicated copies from each of sheet-like documents.

General electrophotographic apparatuses are designed to form copies of thick documents such as books. When a sheet-like document is to be duplicated, the document is placed on a document table and is pressed down by means of a document cover and after that the document table and a projecting optical system are reciprocated relative to each other so as to effect an exposing and scanning.

On the other hand various electrophotographic apparatuses are known in which the sheet-like document is fed by feeding means such as rollers, belts and the like so as to be exposed and scanned. Such a sheet-like document feeding and exposing device has a simple and compact construction as compared with the above mentioned document table exposing device, because it is not necessary to provide a mechanism for driving reciprocally the document table or the projecting optical system. Moreover, in the sheet-like document exposing and scanning device it is not necessary to open and close the document cover for each document and it is sufficient only to insert the document into the device. Therefore it is quite convenient to obtain a single copy from each of a number of documents.

However, in the sheet-like document exposing and scanning device after the document has been scanned it is discharged out of the device and thus it is required to feed the same document repeatedly when a plurality of copies have to be formed. Therefore if a plurality (n) of copies are to be duplicated from each of a plurality (m) of sheetlike documents, these documents must be fed $m \times n$ times. This is very cumbersome as compared with the device in which the document table or the optical system is repeatedly reciprocated so as to obtain a plurality of copies from the same document. It is also known to provide a collator or sorter which can distribute automatically the duplicated copies into n sets of copies. However it is worthless to combine the sheet-like document exposing and scanning device with such a collator and thus there has not been developed such a combination.

At present various kinds of electrophotographic apparatus have been developed in which a plurality of identical copies can be duplicated on the basis of a single image-modulated pattern which has been once formed by a single optical scanning of a document to be copied. for example there have been proposed the following processes:

(1) an electrostatic charge latent image is formed on a photosensitive screen and a plurality of corresponding latent images are formed on a plurality of dielectric record medium with modulating a corona ion stream on the basis of said originally formed latent image;

(2) by using photosensitive material having a persistent internal conductive property due to fatigue of material, an optical image of the document is projected on this photosensitive material so as to form a pattern modulated with the optical image and then a charging step, a developing step and a transferring step are repeatedly carried out so as to form a plurality of identical duplicated copies;

(3) after an electrostatic charge latent image is formed on electrophotographic photosensitive material by carrying out a homogeneously charging step, an optical image projecting step, a developing step and a transferring step are periodically repeated in such a manner that the original latent image is not damaged so as to obtain a plurality of identical copies; and (4) on a photosensitive layer there is formed electrophotographically an image pattern composed of different regions in ink receptive property, charge retentive property or light transmission property and then an ink development step and a transferring step; a corona charging step, a development step and a transfer step; or a corona charging step, a homogeneous irradiation step, a development step and a transfer step are repeatedly effected so as to form a plurality of copies.

SUMMARY OF THE INVENTION

The present invention has for its object to provide an electrophotographic apparatus which has a very simple and compact construction and can form a number of duplicated copies from the same document with a very simple operation by combining the sheet-like document feeding and exposing device with the electrophotographic apparatus which can form a number of copies on the basis of the image-modulated pattern once formed by a single exposing and scanning process.

It is another object of the invention to provide an electrophotographic apparatus which is simple and easy in manipulation and has a very high efficiency by controlling the feeding of a next sheet-like document with the aid of a signal which is obtained from the operation of duplicating a plurality of copies from a single exposing and scanning process.

It is still another object of the invention to provide an electrophotographic apparatus which can be advantageously combined with a collator.

An electrophotographic apparatus according to the invention comprises means for feeding the sheet-like document, means for exposing and scanning the sheet-like document during the traveling of the sheet-like document by means of said feeding means, means for forming an image-modulated pattern corresponding to an image of the sheet-like document during a single exposing and scanning process and retaining the image-modulated pattern thus formed, and means for forming a given number of duplicated copies from the retained image-modulated pattern.

The electrophotographic apparatus according to the invention can be advantageously used for forming a plurality of copies from each of a plurality of sheet-like documents, because in this case each sheet-like document is sufficient to be fed through the exposing and scanning means only once.

A preferred embodiment of the electrophotographic apparatus according to the invention further comprises means for generating a signal in accordance with the duplicating operation for forming the given number of copies, and means for receiving said signal and controlling said document feeding means so as to control the feed for a next sheet-like document.

Another preferred embodiment of the invention further comprises means for generating a first signal each time a single duplicated copy is formed during the duplicating operation for the given number of copies, means for generating a second signal upon the completion of duplicating operation of the given number of copies, and means for receiving said signals and controlling a collator having a plurality of movable trays in such a manner that each of the trays is moved into a given position by means of said first signal and the collator is preset into an initial position by means of said second signal.

DESCRIPTION OF THE PREFERRED EMBODIMENTS

Figure 1:
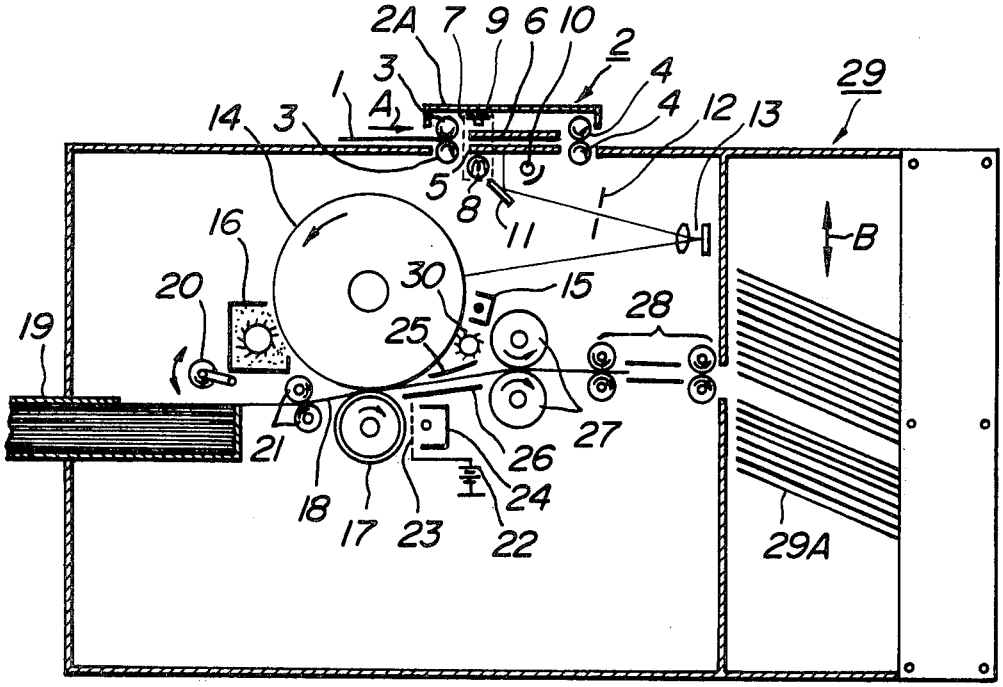
FIG. 1 is a schematic diagram showing an embodiment of an electrophotographic apparatus according to the invention.

FIG. 1 is a schematic diagram showing an embodiment of an electrophotographic apparatus according to the invention. In this embodiment a given number of copies are obtained by repeatedly effecting development and transfer processes for a single electrostatic latent image formed electrophotographically on a photosensitive drum in accordance with an image of a sheet-like document. A sheet-like document 1 to be copied is fed by a sheet-like document feeding device 2 and is exposed and scanned. The document feeding device 2 comprising a pair of feed rollers 3 arranged at an entrance of the feeding device and a pair of discharging rollers 4 at an exit. Between these pairs of rollers 3 and 4 there are provided a pair of guide plates 5 and 6, between which the sheet-like document 1 travels at a given constant velocity. The lower guide plate 5 is made of transparent material such as glass and the upper guide plate 6 is made of white and light reflective material or is coated with a light reflective layer. The rollers 3, 4 and the guide plates 5, 6 are enclosed by an opaque cover 2A.

Immediately behind the document feeding rollers 3 is arranged a document sensor 7 comprising a light emitting element 8 and a light receiving element 9. The document sensor 11 detects an existent of the document so as to produce signals which can be used for starting and stopping the duplicating operation and for waiting the document at a given position. The document sensor 7 may be composed of a microswitch.

While the document 1 travels over the guide plate 5 it is illuminated by an illumination lamp 10 and light reflected from the document 1 is projected by means of a mirror 11, a diaphragm 12 and a projection lens 13 on to a photosensitive drum 14 which rotates in the direction shown by an arrow A. According to the invention the photosensitive drum 14 should have a memory property and thus after an optical image of the document 1 has been once projected onto the drum, the drum should not be irradiated by light. For this purpose in this embodiment a shutter function is given to the diaphragm 12 so as to avoid a decay of the memory property during a multiple copying operation.

Along the photosensitive drum 14 there are arranged a corona charger 15 which charges homogeneously the drum, a toner development device 16 comprising, for example, a magnetic brush for developing the charge latent image with toner particles, a transfer roller 17 for transferring a toner image on the drum onto a record paper 18 and a cleaning brush 30 for removing residual toners on the drum 14.

A number of record papers 18 are piled in a paper cassette 19 and are fed successively one by one by means of a paper feed roller 20 which rotates and swings. The paper 18 is further fed by a pair of feeding rollers 21 and is supplied between the drum 14 and the transfer roller 17.

The record paper 18 having the toner image transferred thereto is separated from the drum by a separating craw 25 and is then fed to a pair of fixing heat rollers 27 along a guide plate 26. The paper 18 having the toner image fixed thereto is further fed by means of a paper feeding mechanism 28 and is discharged from the electrophotographic apparatus.

As to the transfer step it has been proposed to apply transferring charge on to a rear surface of the record paper from a corona charger or to apply a direct current voltage to a conductive or semiconductive transfer roller so as to attract toner particles from the drum to the record paper. However in the former case a potential on the record paper is liable to increase and thus transfer corona charge might transfer to the photosensitive drum, and there might be produced a discharge between the record paper and the drum at a place where they are separated from each other, so that the electrostatic latent image on the drum might be destroyed. In the latter case uneven transfer might be occurred and if the transfer bias potential is increased so as to avoid the uneven transfer phenomenon, the latent image might be destroyed like as the former case. Therefore it is very difficult to apply the known transfer steps to the multiple copying apparatus according to the invention.

In order to carry out the transfer step without destroying the charge latent image on the photosensitive drum it has been found quite effective to apply such a transfer electric field between the drum and the record paper that the toner image on the drum is partly remained on the drum even after the transfer step. To this end the transfer charge or field should be maintained at a lower value which can still effect the transfer operation effectively and stably. This can be carried into effect by combining a transfer roller and a transfer corona charger. For example, the transfer corona charger may be arranged between a pair of transfer rollers. It has been found that by means of such a transfer device about a hundred copies of high quality could be printed from the single latent image once formed on the drum. It is also possible to use a composite transfer roller consisting of a conductive roller and a dielectric layer applied on the conductive roller and this transfer roller is charged by a corona charger. In this case it is preferable to arrange between the corona charger and the roller a grid to which a given bias voltage is applied. By this measure it is possible to keep constant an amount of charge applied on the roller. In this manner while using the homogeneously charged transfer roller an amount of charge applied onto the rear surface of the record paper can be made even and can be limited to a given constant value and thus the stable transfer operation can be effected without deteriorating the latent image on the photosensitive drum. Further it is possible to avoid a problem that under a high humidity a conductivity of the record paper becomes so high that the charge on the rear surface of paper is injected into the photosensitive drum so as to cause annoying fog on the copied image. This is due to the fact that in the known transfer step using only the transfer roller or transfer corona charger since the charge is continuously applied onto the rear surface of paper a potential between the paper and drum is maintained high even if the charge on the paper has been injected into the drum and thus the injection of charge from the paper to the drum is continuously effected so as to increase the amount of injected charge to an inadmissible extent, whereas in the improved transfer step using the homogeneously charged transfer roller since an amount of charge applied onto the paper is limited a potential between drum and paper will be decreased due to the injection of charge from the paper to the drum and thus the injection of charge is ceased or decreased, so that an amount of charge injected onto the drum does not increase to such an amount that a hazardous fog occurs.

In the embodiment of FIG. 1 the transfer roller 17 is of a composite roller composed of a conductive roller and a dielectric layer applied on said conductive roller and the dielectric layer is homogeneously charged by a corona charger 24 through a grid 23 connected to a bias voltage supply source 22.

In this embodiment there is further provided an automatic sorter or collator 29 comprising a plurality of trays 29A which are moved up and down as shown by an arrow B in synchronism with the copying operation of the electrophotographic apparatus. Successive copies discharged from the electrophotographic apparatus are distributed among these trays 29A in a successive manner.

After the charge latent image corresponding to the sheet-like document 1 which has been just fed and scanned by the sheet feeding device 2 has been once formed on the photosensitive drum 14, only the development and transfer steps are repeatedly carried out so as to obtain a number of identical duplicated copies. After the given number of copies have been printed residual latent image and toners on the drum are removed by an erasing lump or corona charger (not shown) and the cleaning brush 30 so as to prepare for a next copying operation.

In the electrophotographic apparatus according to the invention it is possible to form n sheets of copies from each of m sheets of documents by feeding each document only once. For this purpose there may be provided a preset counter by means of which the given number n can be preset and stored, a counter for counting the number of duplicated copies and a sequence control device which produces a signal when the contents of these counters become identical, which signal resets the copy counter, controls the initiation of the duplicating operation in accordance with the existence of the next document and starts the duplicating operation upon the feeding of the next document. The control device may be either electrical or mechanical one and respective elements in the control device may operate independently or may be cooperated.

Figure 2:
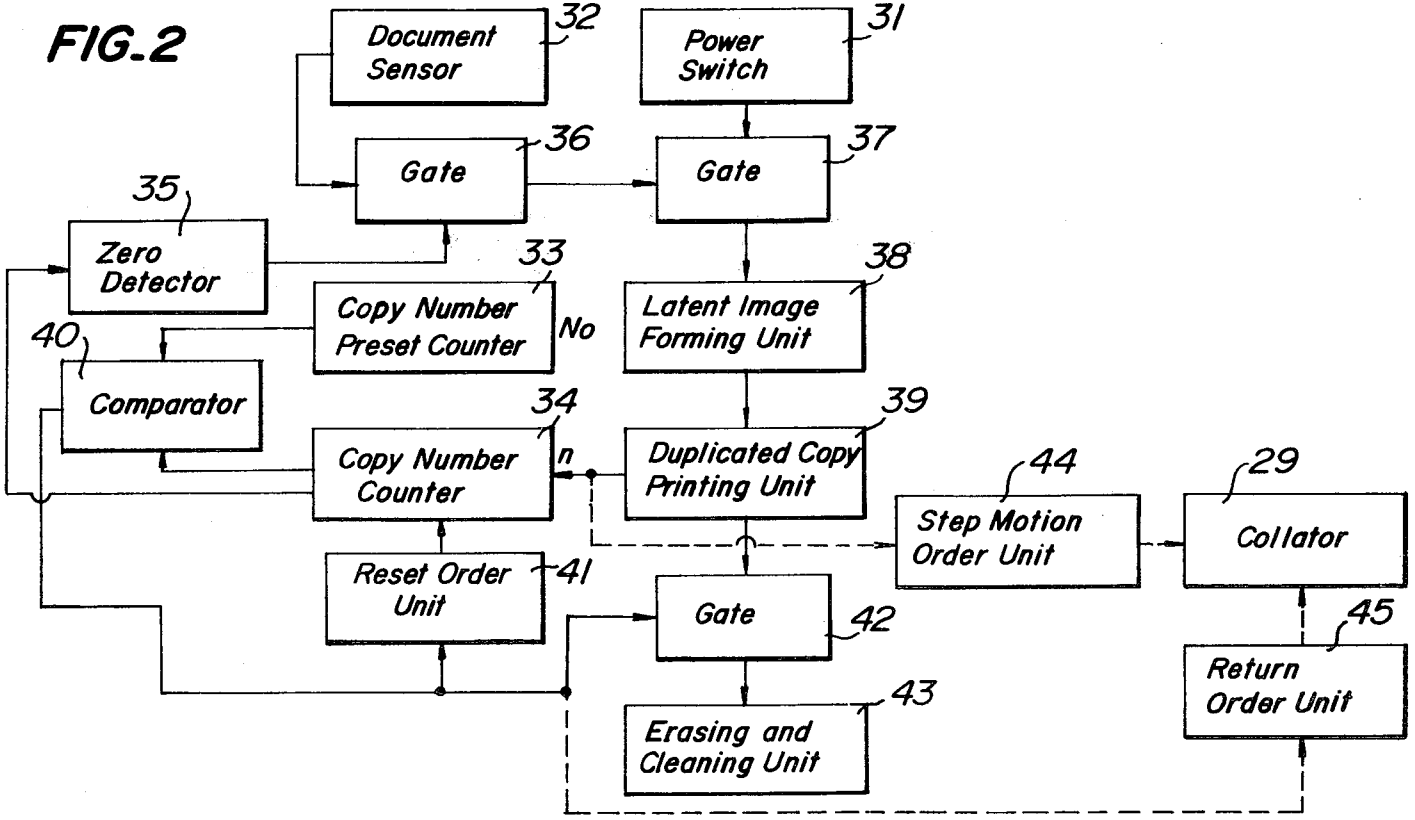
FIG. 2 is a block diagram illustrating an embodiment of a control device for controlling the duplicating operation of the apparatus of FIG. 1.

Next the operation of the electrophotographic apparatus shown in FIG. 1 will be explained also with reference to FIG. 2 which illustrates a block diagram of the control device. During a power switch 31 is closed when the sheet-like document 1 is inserted by a user into the sheet-like document feeding device 2, the document 1 is fed to a position of the document sensor 7 by means of the rotating document feeding rollers 3. When the sensor 7 detects the front edge of the document 1, a document detector switch 32 is made closed. The document feeding rollers 3 may be rotated upon the actuation of the power switch, upon the actuation of a print start switch or upon the detection of the insertion of the document into the document feeding device 2. It should be noted that a counter 33 for presetting the number of copies to be formed has been preset to the given number n. When a zero detector 35 detects the content of a counter 34 for counting the number of duplicated copies to be zero, the zero detector 35 produces a signal which actuates a gate 37 and then the gate 37 supplies a control signal to start the duplicating operation. At first a latent image forming unit 38 is actuated and forms a latent image corresponding to the document 1 on the photosensitive drum 14. The drum 14 can retain the latent image thus formed for a required time period. The latent image forming unit 38 comprises the sheet-like document feeding device 2, illumination lamp 10, mirror 11, diaphragm 12, lens 13, corona charger 15 and drum 14. Following the operation of the unit 38, a duplicated copy forming unit 39 is actuated. Then the number n of copies denoted by the counter 33 are formed from the latent image once formed on the drum 14. The unit 39 includes the development device 16, the paper feed rollers 20, 21, transfer roller 17, corona charger 24, grid 23, bias voltage supply source 22, guide plate 26, fixing rollers 27 and copy feeding mechanism 28.

The number of duplicated copies is counted by the counter 34 and the counted number is compared with the preset number n by a subtracting comparator 40. When the difference between these count numbers is zero, the comparator 40 produces a signal which resets the copy number counter 34 through a reset order unit 41 and also actuates through a gate 43 a latent image cleaning unit 43 for erasing the latent image on the photosensitive drum 14. When the counter 34 is reset to the zero count, the gate 36 produces again the signal by means of the signal from the zero detector 35.

During a duplicating process for n copies, the sheet-like document 1 has been discharged from the document feeding device 2 by means of the discharging rollers 4 which rotate continuously after the power switch 31 is closed. Thus, when the next sheet-like document is inserted into the document feeding device 2, it is fed by the feeding rollers 3 to such a position that the front edge of the document is detected by the document sensor 7 and is forced to stop thereat. Thus the document sensor switch 32 remains in a closed position. This document is fed by the signal from the zero detector 35 upon the completion of the duplicating operation for the n copies and the latent image forming unit 38 is again actuated through the gates 36 and 37.

In case of forming a plurality of copies from each of a plurality of sheet-like documents, successive documents can be set in the document feed device 2 while the duplicating operation for the previous document is carried out and as soon as the duplicating operation for the previous document is ended the next document is fed through the exposing and scanning region.

In this manner the electrophotographic apparatus according to the invention is simple and compact in construction and can form efficiently a plurality of copies with a simple operation.

The duplicated copy forming unit 39 produces a signal each time a single copy is formed and the signal is supplied to a control unit 44 for stepping the trays of the collator 29 so as to move the trays step by step in accordance with the formation of each copy. After the given number of copies have been formed for the single document the signal from the zero detector 40 is supplied to a unit 45 for presetting the trays of the collator to an initial position. In this manner on each of trays of the collator 29 each single copies of the successive documents are successively piled in a given order.

In the electrophotographic apparatus according to the invention the given number of duplicated copies can be effectively printed for each of a plurality of the sheet-like documents by means of the very simple operation, because it is sufficient to feed each of the documents only once. Moreover, since it is not necessary to provide rather complicated mechanism for moving reciprocally either the document table or the optical system the construction of the apparatus of this invention is very simple and compact and thus the whole apparatus may be a very small size.

Furthermore, the function of the collator can be utilized to the maximum extent and thus the efficiency of the electrophotographic apparatus can be further increased.

Furthermore the document can be inserted into the document feed device 2 while the duplicating operation for the previous document is carried out and thus there is enough time to prepare the insertion of the document into the document feed device. This is advantageous for combining an automatic document feed device with the electrophotographic apparatus of the invention, because successive sheet-like documents may be fed positively at a relatively long time interval. The electrophotographic apparatus according to the invention can be advantageously combined with the auto-feeding device and the collator and by means of such a combination a great number of sheet-like documents can be set in the auto-feeding device and a number of sets of copies can be automatically obtained separately.

It should be noted that the present invention is not limited to the embodiments explained above and many modifications are possible within the scope of the invention. For example, in the above embodiment use is made of the photosensitive drum and the latent image is formed electrophotographically by the homogeneous charging and exposing steps. However use may be made of any type of medium which can retain the image-modulated pattern formed therein in accordance with the electrophotographic process.

Further in the above mentioned embodiment use is made of the collator in which the successive trays are moved into the copy receiving position. However use may be made of other type of collator which comprises fixedly arranged trays and means for distributing successive duplicated copies among these trays.

What is claimed is:

1. An electrophotographic apparatus for forming a number of duplicated copies from each of sheet-like documents comprising: means for feeding said sheet-like document at a constant velocity through an exposing and scanning position; optical means fixed in said apparatus for exposing and scanning the sheet-like document at said position, which the sheet-like document is forwarded at the constant velocity by said feeding means; means for forming an imagewise-modulated pattern corresponding to an image of the sheet-like document during a single exposing and scanning process, and retaining the imagewise-modulated pattern thus formed; means for forming a given number of duplicated copies from the retained imagewise-modulated pattern; means for generating a signal in accordance with the duplicating operation for forming the given number of copies of a sheet-like document; and means for receiving said signal and controlling said document feeding means so as to retain a next sheet-like document at a stand-by position during the duplicating operation for forming the given number of copies of the previous document and to initiate the feed of the next document after a time when the imagewise-modulated pattern of the previous document can be erased at the end of the duplicating operation for forming the given number of copies of the previous document.

2. An apparatus according to claim 1, wherein: said imagewise-modulated pattern is an electrostatic charge image formed and retained on an electrophotographic photosensitive member and said means for forming a given number of copies from the electrostatic charge image comprises means for developing the charge image with toners to form a toner image, means for transferring the toner image onto a record paper, and means for repeatedly feeding the charge image to the developing and transferring means in succession.

3. An apparatus according to claim 1, wherein: said imagewise-modulated pattern is an electrostatic charge image formed and retained on an electrophotographic photosensitive screen and said means for forming a given number of copies from the electrostatic charge image comprises means for forming on a dielectric member an electrostatic charge image corresponding to the charge image by modulating a corona ion stream with the charge image on the screen, means for developing the charge image on the dielectric member with toners, and means for repeatedly feeding the charge image on the screen to the charge image forming and developing means in succession.

4. An apparatus according to claim 1, wherein said controlling means comprises a first counter for presetting the given number of duplicated copies to be formed, a counter for counting the number of duplicated copies, and a second comparator for comparing the contents of these counters, whereby said document feeding means is controlled by a signal supplied from the comparator.

5. An apparatus according to claim 1, further comprising means for generating a first signal each time a single duplicated copy is formed during the duplicating operation for the given number of copies;

means for generating a second signal upon the completion of the duplicating operation of the given number of copies; and means for receiving said first and second signals and controlling a collator having a plurality of trays in such a manner that each of the trays can receive a respective one of the duplicated copies by means of said first signal and the collator is preset into an initial state by means of said second signal.

* * * * *